US008709214B2

(12) United States Patent
Inoue et al.

(10) Patent No.: US 8,709,214 B2
(45) Date of Patent: Apr. 29, 2014

(54) BELT FOR TRANSFERRING WET WEB

(71) Applicant: Ichikawa Co., LTD., Tokyo-to (JP)

(72) Inventors: Kenji Inoue, Tsuchiura (JP); Ryo Umehara, Kasama (JP); Ai Tamura, Tsuchiura (JP); Toshihiro Tsuji, Ushiku (JP)

(73) Assignee: Ichikawa Co., Ltd., Tokyo-To (JP)

( * ) Notice: Subject to any disclaimer, the term of this patent is extended or adjusted under 35 U.S.C. 154(b) by 0 days.

(21) Appl. No.: 13/650,211

(22) Filed: Oct. 12, 2012

(65) Prior Publication Data

US 2013/0092339 A1 Apr. 18, 2013

(30) Foreign Application Priority Data

Oct. 12, 2011 (JP) ..... 2011-236491

(51) Int. Cl.
*D21F 3/00* (2006.01)

(52) U.S. Cl.
USPC ..... 162/358.2

(58) Field of Classification Search
USPC ..... 162/358.2, 302, 358.4, 901; 474/260, 474/263, 230, 237
See application file for complete search history.

(56) References Cited

U.S. PATENT DOCUMENTS

| | | | | |
|---|---|---|---|---|
| 6,036,819 | A | 3/2000 | Miller et al. | |
| 6,056,656 | A * | 5/2000 | Kitano et al. | 474/268 |
| 7,128,811 | B2 | 10/2006 | Watanabe | |
| 7,244,207 | B2 * | 7/2007 | Shiriike et al. | 474/260 |
| 7,722,741 | B2 | 5/2010 | Gronych et al. | |
| 7,776,188 | B2 | 8/2010 | Morton et al. | |
| 8,092,654 | B2 | 1/2012 | Yazaki et al. | |
| 8,257,555 | B2 | 9/2012 | Inoue et al. | |
| 2010/0298079 | A1 * | 11/2010 | Shiriike et al. | 474/238 |

FOREIGN PATENT DOCUMENTS

| | | | |
|---|---|---|---|
| DE | 10 2008 041 245 | A1 | 2/2010 |
| EP | 1 870 514 | A2 | 12/2007 |
| JP | 2000-27088 | A | 1/2000 |
| JP | 2004-84125 | A | 3/2004 |
| JP | 2009-127134 | A | 6/2009 |
| JP | 2011-111693 | A | 6/2011 |
| WO | WO 2008/131979 | A1 | 11/2008 |

OTHER PUBLICATIONS

Office Action issued Apr. 27, 2012 in Japanese Patent Application No. 2011-236491 (with English-language translation).
Nara, "A method for measuring and evaluating the surface roughness," United Engineering Center Co., Ltd., Dec. 15, 1983 (with partial English Translation).
Extended Search Report issued Mar. 7, 2013 in European Patent Application No. 12007097.4.

* cited by examiner

*Primary Examiner* — Mark Halpern
(74) *Attorney, Agent, or Firm* — Oblon, Spivak, McClelland, Maier & Neustadt, L.L.P.

(57) ABSTRACT

Provided is a belt for transferring a wet web, wherein any water mark does not appear on made paper even when a rate of feeding the belt for transferring a wet web by a roll is high. The roll side layer surface of the belt for transferring a wet web has the surface structure in which the percentage of a contact area with the roll per unit area is 10% to 75% and a surface roughness Ra is 50-150 μm.

5 Claims, 6 Drawing Sheets

BELT FOR TRANSFERRING WET WEB

CROSS REFERENCE TO RELATED APPLICATIONS

This application claims priority to Japanese Patent Application No. 2011-236491, filed Oct. 12, 2011, the disclosure of which is incorporated herein by reference in its entirety.

BACKGROUND

Papermaking machines for removing moisture from the source material of paper are generally equipped with a wire part, a press part, and a drier part. These parts are disposed in the order of the wire, press, and drier parts along the direction in which a wet web is conveyed.

In one type of papermaking machine, the wet web is passed in an open-draw. In the press part of this open-draw papermaking machine, there is a location where the wet web is not supported by a paper-making tool, such as a felt or a belt, or a roll, i.e., a location where the wet web passes alone. Problems, such a breakage of the paper, tend occur in this location. The risk of such difficulties increases when such open-draw papermaking machines are operated at high speed. Accordingly, open-draw papermaking machines have been limited with respect to higher-speed operation to some extent.

In view of the foregoing difficulties, in recent years, a type of papermaking machine in which a wet web is passed in a closed-draw has become mainstream. In the press part of such closed-draw papermaking machines, the wet web is conveyed while being placed on a felt for papermaking or a belt for transferring a wet web. As a result, there is no location where the wet web passes alone, as in open-draw papermaking machines. As a result, it is possible to operate such papermaking machines at higher speeds and stabilization of operation also results.

An example of a press part of a closed-draw papermaking machine is described in detail with reference to FIG. 3. A papermaking part of the closed-draw papermaking machine includes a wire part, a press part and a drier part, in sequence in the direction in which a wet web is conveyed. The press part in FIG. 3 is an example of a press part for a closed-draw papermaking machine having two press devices. A first press device 1P formed of a top roll 1*a* and a bottom roll 1*b* and a second press device 2P formed of a top roll 2*a* and a bottom roll 2*b*. The first press device 1P and the second press device 2P are provided adjacently in series along the direction in which the wet web is conveyed.

In the closed-draw papermaking machine shown in FIG. 3, a plurality of felts PUF, 1PBF, and 2PTF for papermaking are used. The pickup felt PUF receives the wet web WW from the wire part WF and is used in the top roll side of the first press device 1P. The bottom felt 1PBF receives the wet web WW from the pickup felt PUF and is used in the bottom roll side of the first press device 1P. The top felt 2PTF receives the wet web WW from the bottom felt 1PBF and is used in the top roll side of the second press device 2P. In addition, a belt TFB for transferring a wet web receives the wet web WW from the top felt 2PTF and is used in the bottom roll side of the second press device 2P. The belt TFB for transferring a wet web may also be used in the top roll side of the second press device 2P; however, in this case, the felt for papermaking is used in the bottom roll side of the second press device 2P from the viewpoint of squeezing out water from the wet web.

In these felts PUF, 1PBF, and 2PTF for papermaking, batt fibers are needled on one surface or both surfaces of a reinforcing fiber substrate, and the belt TFB for transferring a wet web is an endless belt, in which a polymer resin is layered on at least the wet web contact surface of the reinforcing fiber substrate. The felts PUF, 1PBF, and 2PTF and the belt TFB are supported by guide rolls GR and suction rolls SR, as illustrated in FIG. 3.

In an alternative papermaking machine configuration, a shoe press device is formed in any one or more of the top rolls 1*a*, 2*a* and bottom rolls 1*b*, 2*b* in the press device. In such a papermaking machine in which the shoe press device is formed in the press device, a felt for papermaking is used on a shoe press device side and a belt for transferring a wet web is used on a roll side facing the shoe press device. The number of press devices disposed in the press part is not limited to two exhibited in one example as described above and one press device or three or more press devices may also be disposed.

In the example of FIG. 3, water is squeezed from the wet web WW by the first press device 1P and the second press device 2P. When attention is focused on the second press device 2P, the top felt 2PTF which is used in the second press device 2P is water-permeable whereas the belt TFB for transferring a wet web is not water-permeable. Thus, in the second press device 2P, moisture moves from the wet web WW to the top felt 2PTF and is drained to the outside of the press device system but some moisture remains in the top felt 2PTF.

Immediately after leaving the press part of the second press device 2P, the respective volumes of the top felt 2PTF, the belt TFB for transferring a wet web, and the wet web WW pinched between them expand because of a sudden release of pressure. Due to this expansion and the capillary phenomenon of the pulp fibers constituting the wet web WW, a re-wetting phenomenon occurs during which some of the moisture remaining in the top felt 2PTF moves to the wet web WW.

Nevertheless, since the belt TFB for transferring a wet web is not water-permeable as described above, moisture is not retained in the polymer resin of the wet web contact surface. Thus, the re-wetting phenomenon from the belt TFB for transferring a wet web rarely occurs; and the belt TFB for transferring a wet web contributes to improvement in efficiency of squeezing out water of the wet web WW. The wet web WW leaving the press part 2P is conveyed by the belt TFB for transferring a wet web, moves to a drier fabric DF via the suction roll SR, and is conveyed to the drier part.

In the papermaking step, the belt for transferring a wet web preferably contributes to:

1) adhesiveness and releasability of the wet web on the wet web-side surface of the belt for transferring a wet web;

2) cooperation with the felt for papermaking in the press device; and 3) stable traveling performance in the closed-draw and durability.

Various belts for transferring a wet web have conventionally been proposed to perform the above-described functions.

For example, U.S. Pat. No. 7,722,741 discloses a belt for transferring a wet web formed of an impermeable polymer layer having a wet web contact side and a roll side, wherein the surface structure of the roll side has a porous structure or a surface roughness Ra (arithmetic mean roughness) of 3-40 μm. In the above-described surface structure, grooves and protrusions are formed so that the porous structure is maintained under pressurization by a press device. Receptivity for fluid acting on the roll side is consequently formed to prevent skids between a belt for transferring a wet web and various rolls, particularly a guide roll for controlling the travel position of the belt for transferring a wet web, caused by a hydroplaning phenomenon to maintain stable traveling performance. Thus, the belt for transferring a wet web is further prevented from being damaged by fluid under pressurization.

U.S. Pat. No. 7,776,188 discloses a belt for transferring a wet web formed of an impermeable polymeric layer having a wet web contact side and a roll side, wherein a plurality of grooves or flute-like recesses are formed in the roll side and the respective surface roughnesses of the plurality of recesses are lower than the surface roughness of the roll side surface. The belt for transferring a wet web is provided with static friction crucial for operating the belt for transferring a wet web by the roll side surface having surface roughness to some extent. A hydroplaning phenomenon is prevented by further lowering the surface roughness of each of the plurality of recesses, and fluid or impurities entering into the recesses are more effectively shaken from the belt.

However, the belts for transferring a wet web described in U.S. Pat. No. 7,722,741 and U.S. Pat. No. 7,776,188, have had problems, such as cracks caused by forming the grooves in the roll side and groove marks copied on the wet web via the wet web contact side surface of the belt for transferring a wet web. In addition, in the belt for transferring a wet web described in U.S. Pat. No. 7,722,741, although receptivity for fluid is formed at the surface roughness of the surface structure of the roll side of 3-40 μm, the belt has been insufficient from the viewpoint of preventing a hydroplaning phenomenon or damage to the belt for transferring a wet web.

WO 2008/131979 discloses a belt for transferring a wet web formed of an impermeable polymeric layer having a wet web contact side and a roll side, wherein the wear resistance of the roll side is made to be more than the wear resistance of the wet web side. In the belt for transferring a wet web described in WO 2008/131979, the life of the belt for transferring a wet web is improved by mixing a polymer layer constituting the roll side with fibers or calcium carbonate to improve the wear resistance of the roll side.

JP-A-2000-027088 proposes a belt for a papermaking step. The belt is coated with a polymeric resin and includes a reinforcing substrate (reinforcing fiber substrate). The coating of a polymeric resin material is provided on the front side of the reinforcing substrate, and a staple fiber batt is attached to the back side of the reinforcing substrate. The reinforcing substrate has an endless loop shape and the front and back sides. The front side is the outside of the endless loop, and the back side is the inner side of the endless loop. The staple fiber batt has a smooth molten surface, and there is no fiber end that protrudes from the staple fiber batt in the surface. The belt for a papermaking step is a belt for transferring a wet web, including a water-impermeable coating resin layer placed on the wet web contact side of the reinforcing substrate and a batt fiber layer placed on the roll side of the reinforcing substrate. The fibers on the roll side surface of the batt fiber layer are molten to smooth the surface. In this belt for transferring a wet web, since the roll side surface is smooth, impurities rarely adhere to the belt and damage to the batt fiber layer or the reinforcing substrate due to the adhesion of impurities is prevented.

However, the belts for transferring a wet web described in WO 2008/131979 and JP-A-2000-027088 are insufficient from the viewpoint of preventing a hydroplaning phenomenon since the roll sides are smooth. Further, since the roll side is constituted by the batt fiber layer and a molten material thereof, the belt for transferring a wet web as described in JP-A-2000-027088 has comparatively lower strength than that of the polymeric resin coat layer and is easy to be damaged by high-pressure washing applied to the roll side surface in the course of or during use. As a result, the fibers of the batt fiber layer may fall off with the damage to shorten the life of the belt for transferring a wet web. In other words, it has been necessary to control the feed rate (guiding characteristic) of the belt for transferring a wet web to 1,300 m/min or less.

SUMMARY

The present invention is aimed at preventing skids between a belt for transferring a wet web and various rolls, particularly a roll for controlling a travel position, caused by a hydroplaning phenomenon, at preventing the belt for transferring a wet web from being damaged by fluid under pressurization, at improving the wear resistance of the roll side of the belt for transferring a wet web, at solving the problem that groove marks are copied on the wet web via the wet web contact side surface of the belt for transferring a wet web, and at providing the belt for transferring a wet web, which enables the feed rate of the belt for transferring a wet web of 1,500 m/min or more.

In an exemplary embodiment of the present invention, a belt for transferring a wet web, comprises a reinforcing fiber substrate buried in a water-impermeable resin layer. The belt for transferring a wet web comprises a wet web contact side layer which contacts with a wet web and a roll side layer opposite to the wet web contact side layer. A roll side layer surface of the roll side layer comprises a surface structure in which a percentage of a contact area with a roll per unit area is 10% to 75% and has a surface roughness Ra of 50-150 μm.

In an exemplary embodiment of the present invention, in the belt for transferring a wet web described above, the roll side layer comprises a batt fiber or staple fibers in the above-described belt for transferring a wet web, including a surface structure in which a part of the fiber protrudes from the surface of the roll side layer.

In an exemplary embodiment of the present invention, in the belt for transferring a wet web described above, the resin in the water-impermeable resin layer is made of polyurethane obtained by heating and curing a coating agent including a polyurethane resin composition containing a urethane prepolymer, a chain extender, and an inorganic filler.

In embodiments of the belt for transferring a wet web of the present invention, the surface of the roll side layer is roughened to have a surface roughness Ra (arithmetic mean roughness) of 50 μm or more to facilitate detachment from a roll. Skidding between a belt for transferring a wet web and various rolls, particularly a roll for controlling a travel position, caused by a hydroplaning phenomenon can be prevented by decreasing the percentage of a contact area with the roll per unit area (10% as a lower limit), which is the parameter of the number of contacting protrusions of the roll side layer surface contacting with the roll, since an amount of water interfering with papermaking is more than 35 mg when the surface roughness Ra (arithmetic mean roughness) is more than 150 μm. Thus, the feed rate of the belt for transferring a wet web can be improved to than 1,500 m/min or more. In addition, since a water-impermeable resin is used, the belt for transferring a wet web is not damaged by fluid (water) under pressurization and the life of the belt for transferring a wet web is improved. Further, paper in which wet web marks are not present can be manufactured.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF EXEMPLARY EMBODIMENTS

Other features of the invention will become apparent in the course of the following descriptions of exemplary embodiments which are given for illustration of the invention and are not intended to be limiting thereof.

Figure 1:
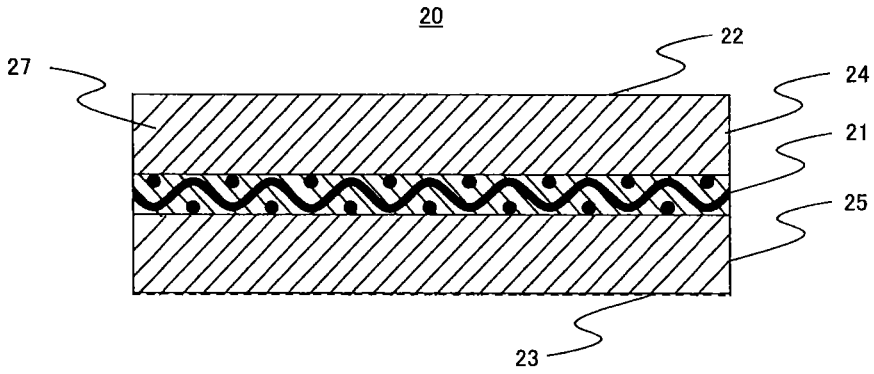
FIG. 1 is a schematic cross-sectional view of an exemplary belt for transferring a wet web in accordance with the present invention.
Figure 2:
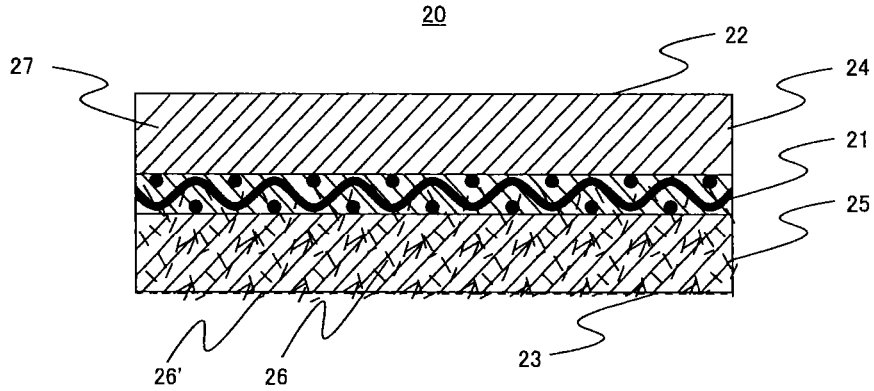
FIG. 2 is a schematic cross-sectional view of an exemplary belt for transferring a wet web in accordance with the present invention.
Figure 3:
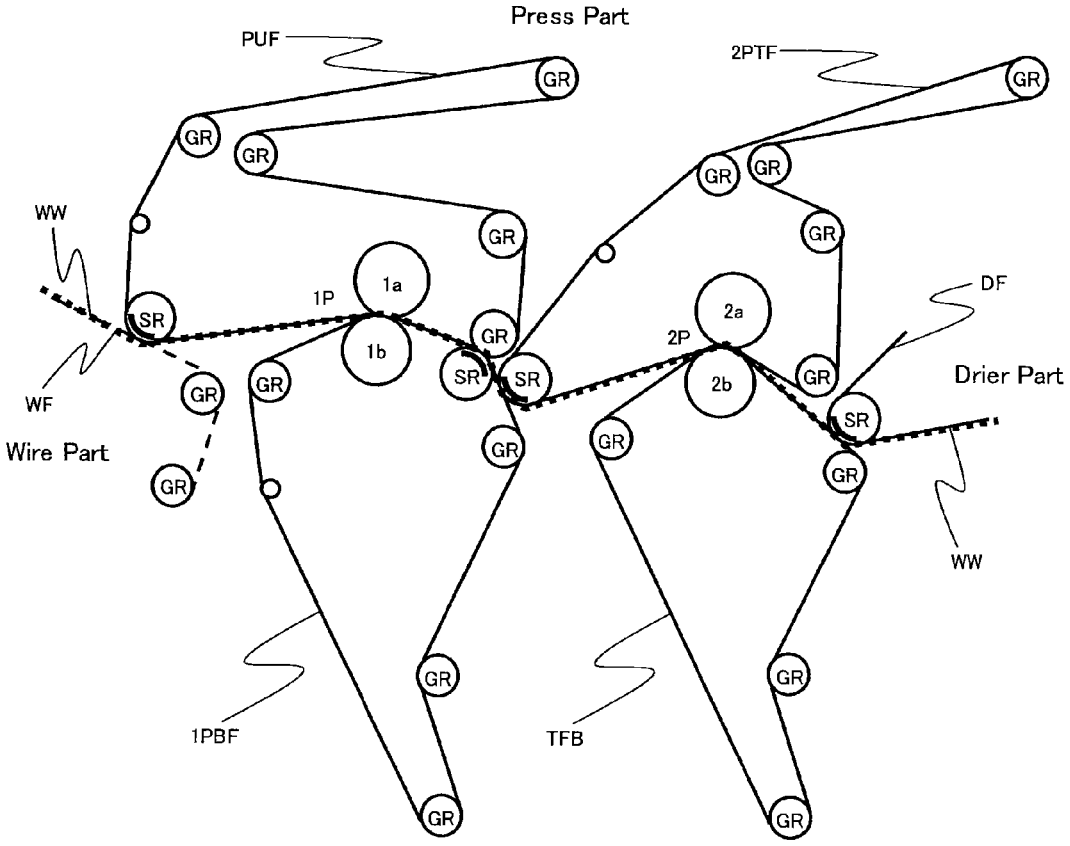
FIG. 3 is a schematic view of a press part of a known papermaking machine.

Various exemplary embodiments of the present invention will be described in detail below with reference to the drawings. An exemplary belt for transferring a wet web (hereinafter "belt") 20 used in a press part of a papermaking machine is illustrated in FIG. 1 and FIG. 2. The belt 20 includes a reinforcing fiber substrate 21 buried in a water-impermeable resin layer 27. The belt 20 includes a wet web contact side layer 24 which contacts with a wet web WW and a roll side layer 25 opposite to the wet web contact side layer 24. A surface 23 of the roll side layer 25 includes a surface structure in which the percentage of a contact area with a roll per unit area is 10% to 75% and has a surface roughness Ra (arithmetic mean roughness) of 50-150 μm.

The roll side layer 25 of the exemplary belt 20 illustrated in FIG. 2 contains a batt fiber or staple fibers 26 and includes a surface structure in which parts of the fibers 26 protrude from the surface 23 of the roll side layer 25 to create an irregular distribution of recesses and protrusions.

In the exemplary belt 20 illustrated in FIG. 2, a substrate needling-processed with the batt fibers 26, which is buried in the roll side layer 25 of the reinforcing fiber substrate 21, is illustrated, and the wet web contact side layer 24 may also be needling-processed with the batt fiber 26.

For the reinforcing fiber substrate 21, a woven fabric prepared by weaving warps and wefts by a weaving machine or the like is generally used; however, a lattice-shaped material prepared by overlaying warp and weft lines without weaving them may also be used. The reinforcing fiber substrate 21 is a reinforcing material that bears a load during roll-feeding the loop-like belt 20.

As exemplary materials for the reinforcing fiber substrate 21 and the batt fiber 26 or the staple fibers 26, thermoplastic polyesters (such as polyethylene terephthalate and polybutylene terephthalate), aliphatic polyamides (such as polyamide 11, polyamide 12, and polyamide 612), aromatic polyamides (aramid), polyvinylidene fluoride, polypropylene, polyethylene ester ether ketone (referred to as PEEK), polytetrafluoroethylene (referred to as PTFE), polyethylenes, sheep wool, cotton, wool, metals, and/or the like may be used.

As exemplary materials for the water-impermeable resin 27, a thermosetting resin such as a polyurethane composition containing a curing agent (also referred to as a chain extender) having a urethane prepolymer and an active hydrogen group, an epoxy resin composition containing a liquid epoxy resin and a curing agent, or a liquid acrylic resin composition containing a liquid acrylic resin and a thermal decomposition-type curing or light irradiation curing catalyst, which thermosetting resin is a resin which is cured at a lower temperature than the melting points of the reinforcing fiber substrate 21 and the fiber 26 to form a continuous solid film which is substantially water-impermeable (a water permeability of less than 1.0% by weight); or a thermoplastic resin such as polyamide, polyarylate, or thermoplastic polyester may appropriately be used. When the reinforcing fiber substrate 21 is made of a thermoplastic resin, a heat-curable polyurethane composition containing a curing agent (also referred to as a chain extender) having a urethane prepolymer and an active hydrogen group is preferred for a coating characteristic on the reinforcing fiber substrate 21 and selection of temperatures (low temperatures of 80-135° C.) at which the heat-curable polyurethane composition is heated.

The urethane prepolymer is preferably a urethane prepolymer having an isocyanate group (—NCO) obtained by reacting a diisocyanate compound such as toluene diisocyanate (TDI), diphenylmethane diisocyanate (MDI), or para-phenylene diisocyanate (PPDI) with an aliphatic polyol such as tetramethylene glycol (PTMG), tetraethylene glycol (PTEG), or polyethylene glycol (PEG).

The curing agent having an active hydrogen group is preferably an aliphatic diol such as 1,4-butanediol or diethylene glycol; or an aromatic diamine such as dimethyl thio toluene diamine (commercially available as Ethacure 300), 1,2-bis(2-aminophenylthio)ethane, methylene-bis-(ortho-chloroaniline), or 4,4'-methylene-bis-(3-chloro-2,6-diethylaniline).

The curing agent having an active hydrogen group (—H) is used at a —H/—NCO equivalent ratio of 0.90-1.15 with respect to the —NCO group of the urethane prepolymer having the isocyanate group (—NCO).

The resin which forms the water-impermeable resin 27 may also contain an inorganic filler such as titanium oxide, calcined kaolin, clay, talc, diatomaceous earth, calcium carbonate, calcium silicate, magnesium silicate, fused silica, mica, or zeolite; or such an inorganic filler of which the surface is modified with a silane coupling agent such as an organosiloxane compound having an active hydrogen group, at a rate of 1-30% by weight.

As an exemplary method for homogeneously mixing the water-impermeable resin 27 with the above-described inorganic filler, in the case of a thermosetting resin in which a water-impermeable resin composition is liquid at ordinary temperature (25° C.), the inorganic filler is added to make a homogeneous water-impermeable resin composition while stirring the thermosetting resin 27 with a stirrer in a stirred tank at room temperature. In the case of a resin composition in which a water-impermeable resin composition is solid at ordinary temperature (25° C.), a heating stirred tank is preheated to melt the resin composition, the inorganic filler is added to make a homogeneous water-impermeable resin composition while being stirred with a stirrer, the water-impermeable resin composition with flowability is supplied to a coater machine 46 and heated and extruded onto the reinforcing fiber substrate 21, and the water-impermeable resin composition is heated to post-cure temperature to form the water-impermeable resin layer 27.

In various exemplary embodiments, irregularly dispersed recesses and protrusions are formed on the roll side layer surface 23 of the belt 20. Spaces for receiving fluid (water and air) are formed in the roll side layer surface 23 of the belt 20 by the presence of the recesses and the protrusions. Skids between the belt 20 and various rolls, particularly a roll for controlling the travel position, caused by a hydroplaning phenomenon, can be prevented, and the belt 20 can be prevented from being damaged by fluid under pressurization. Further, wet web marks do not appear on paper made using the belt 20.

Further, since, in embodiments, a part 26' of the staple fibers 26 or the batt fiber 26 needled in the roll side surface of the reinforcing fiber substrate 21 protrudes from the roll side layer surface 23 to form the surface with irregular recesses and protrusions together with the recesses and the protrusions of the roll side layer 25 of the belt 20, the wear resistance of the roll side layer surface 23 and the roll side layer 25 of the belt 20 can be improved.

In embodiments, the roll side layer surface 23 of the roll side layer 25 of the belt 20 has a surface structure in which a percentage of contact area with the roll per unit area is 10% to 75%, preferably 10% to 65%, and a surface roughness Ra (arithmetic mean roughness) of 50-150 μm, preferably 60-120 μm.

Next, exemplary methods for specifically manufacturing belts 20 in accordance with embodiments of the present invention will be described with reference to FIG. 4 and FIG. 5.

First, the "back surface coat reverse manufacturing method" is described with reference to FIG. 4. As illustrated in FIG. 4(*a*), the loop-like (endless) reinforcing fiber substrate 21 is put so that the surface (wet web contact side layer, 44) of the reinforcing fiber substrate contacts with two rolls 41, 41 which are disposed in parallel. Then, the water-impermeable resin 27 is discharged from the resin discharge port of the coater machine 46 to the back surface (roll side layer, 45) of the reinforcing fiber substrate 21 while rotating the rolls 41, 41 and the back surface 45 of the reinforcing fiber substrate 21 is coated (applied) with the water-impermeable resin 27 via a coater bar 42. Then, the water-impermeable resin 27 is cured while forming recesses and protrusions on the water-impermeable resin 27 surface (the roll side layer surface of the belt for transferring a wet web) by an emboss roll 47 within the period during which the water-impermeable resin 27 is in an uncured state after finishing the application operation of the water-impermeable resin 27. After curing the water-impermeable resin 27, as needed, a polishing apparatus is placed instead of the emboss roll and the surface roughness (Ra) of the resin surface (the roll side layer surface 23 of the belt for transferring a wet web) may also be adjusted to 50-150 μm, preferably 60-120 μm, by the polishing apparatus. The roll side layer surface 23 has a surface structure in which the percentage of a contact area with the roll per unit area is 10% to 75%, preferably 10% to 65%.

Figure 4:
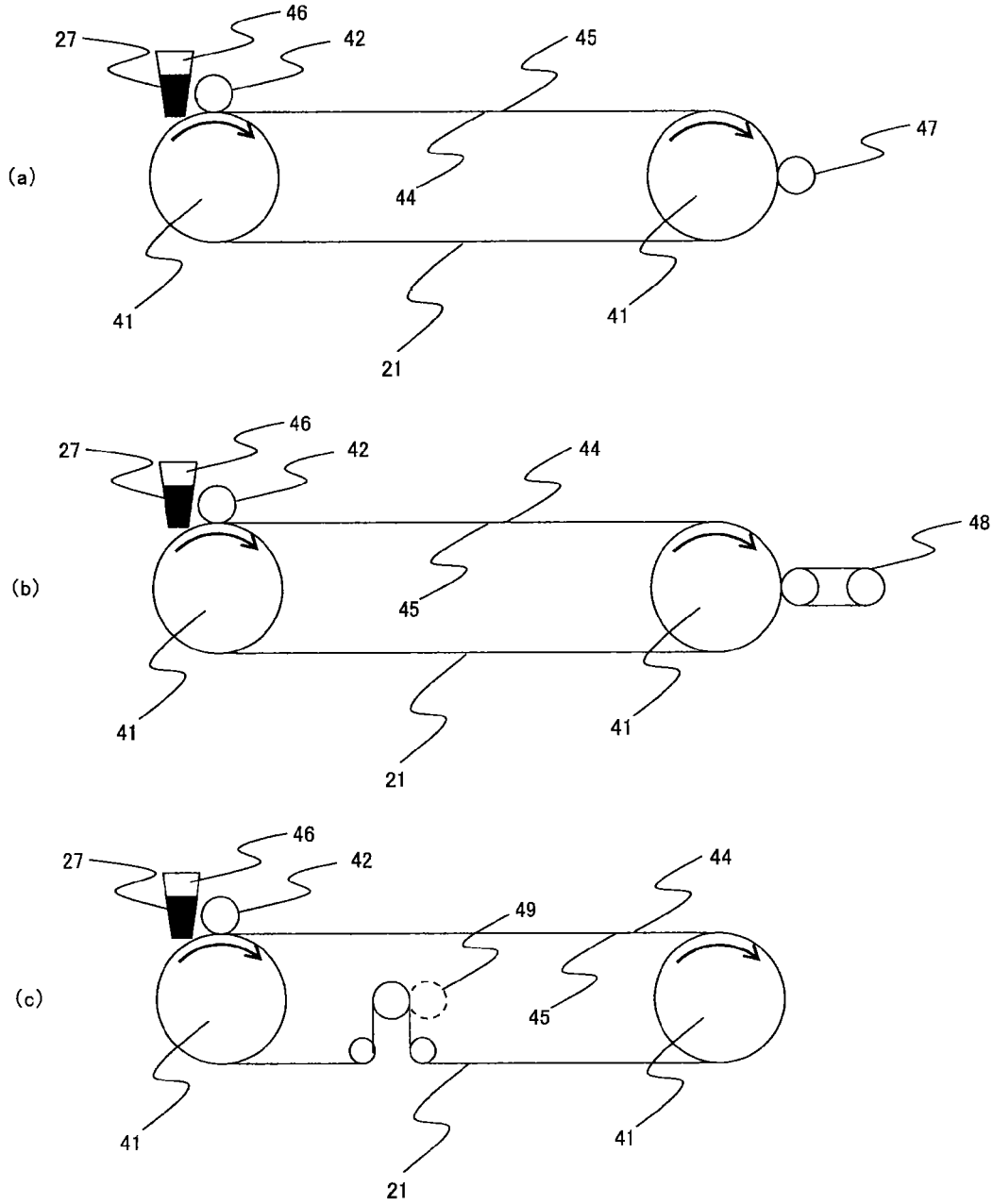
FIG. 4 is a schematic depiction of an exemplary method for manufacturing a belt for transferring a wet web in accordance with the present invention.

Then, as illustrated in FIG. 4(*b*), the water-impermeable resin 27 layer formed on the back surface (roll side layer, 45) of the reinforcing fiber substrate 21 is reversed and put into contact with the roll 41. Then, the water-impermeable resin 27 is discharged from the resin discharge port of the coater machine 46 to the surface (wet web contact side layer, 44) of the loop-like reinforcing fiber substrate 21 while rotating the roll 41 and the water-impermeable resin 27 is coated (applied) on to the surface 44 of the reinforcing fiber substrate 21 via the coater bar 42. Then, after finishing the application operation of the water-impermeable resin 27, the applied water-impermeable resin 27 is heated and cured, followed by polishing the water impermeable resin 27 surface forming a wet web contact side layer surface 22 by the polishing apparatus 48 to be able to manufacture the belt 20 of which the percentage of contact area of the wet web contact side layer surface 22 with the roll per unit area is 85% or more and the surface roughness Ra (arithmetic mean roughness) is 3-40 μm.

In the above-mentioned "back surface coat reverse manufacturing method" of a belt for transferring a wet web, an example of using only the reinforcing fiber substrate 21 as an object to be applied with the water-impermeable resin 27 has been described; however, the reinforcing fiber substrate in which the batt fiber 26 is needled in the at least roll side surface of the reinforcing fiber substrate 21 may also be used. The water-impermeable resin composition 27 in which the water-impermeable resin 27 to be applied is mixed with the staple fibers 26 may also be applied to form the water-impermeable resin layers (roll side layer 25, wet web side layer 24) of the belt 20.

As illustrated in FIG. 4(*c*), groove-processing of the roll side layer surface 23 of the belt may also be performed by a grooving device 49 disposed in the belt 20.

Next, the "surface coat penetration manufacturing method" will be described with reference to FIG. 5. As illustrated in FIG. 5(*a*), the loop-like reinforcing fiber substrate 21 is put so that the back surface (roll side layer, 55) of the reinforcing fiber substrate contacts with two rolls 51, 51 disposed in parallel. Then, the water-impermeable resin 27 is discharged from the resin discharge port of the coater machine 56 to the surface (wet web contact side layer, 54) of the reinforcing fiber substrate 21 while rotating the rolls 51, 51 and the surface 54 of the reinforcing fiber substrate 21 is coated with the water-impermeable resin 27 via a coater bar 52. In this case, the roll side layer 25 and the wet web side layer 24 of the water-impermeable resin layer 27 of the belt 20 can simultaneously be formed by making the applied water-impermeable resin 27 penetrate from the surface 54 of the reinforcing fiber substrate 21 to the back surface 55 and heating and curing the resin. Then, after finishing the heating and curing operation of the applied water-impermeable resin layer 27, the belt 20 can be manufactured by polishing the resin surface (the wet web contact side surface 22 of the belt for transferring a wet web) by a polishing apparatus 58. As illustrated in FIG. 5(*b*), the roll side surface 23 of the belt may also be polished by the polishing apparatus 58 disposed in the belt for transferring a wet web.

In the above-mentioned "surface coat penetration manufacturing method" of the belt for transferring a wet web, an example of using only the reinforcing fiber substrate 21 as an object to be coated with the water-impermeable resin layer 27 has been described; however, the reinforcing fiber substrate in which the batt fiber 26 are needled in the at least roll side surface of the reinforcing fiber substrate may also be used. The water-impermeable resin composition in which the water-impermeable resin layer 27 is mixed with the staple fibers 26 may also be used to form the roll side layer 25 and the wet web side layer 22 of the water-impermeable resin layer 27 of the belt 20.

Figure 5:
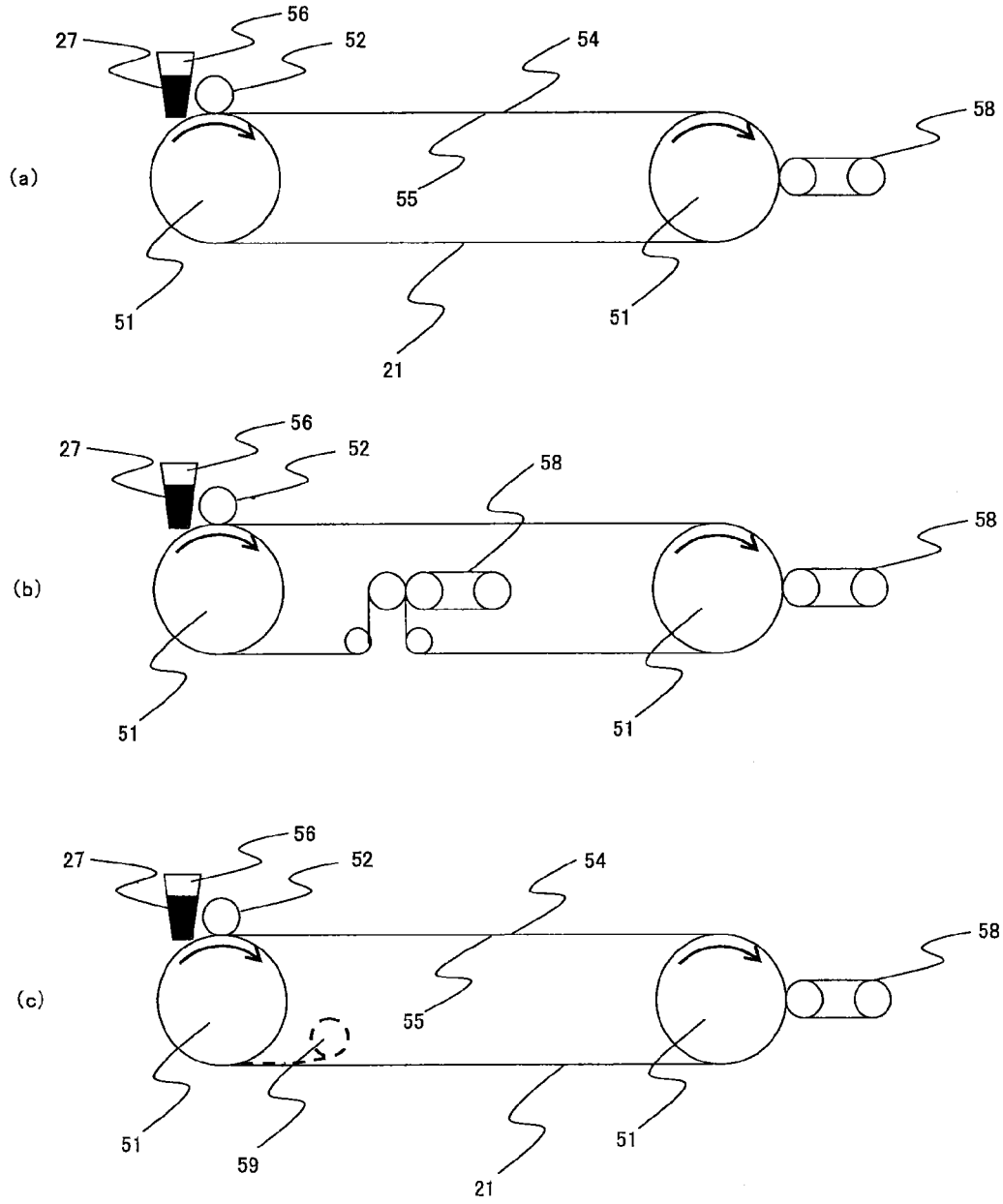
FIG. 5 is a schematic depiction of an exemplary a method for manufacturing a belt for transferring a wet web in accordance with the present invention.

Further, as illustrated in FIG. 5(*c*), the belt 20 in which a batt fiber 59 is buried in the roll side of the reinforcing fiber substrate 21 can be manufactured by adhering the batt fiber (in mat form, 59) to the water-impermeable resin 27 in an uncured state, which penetrates to the back surface 55 of the reinforcing fiber substrate 21, sandwiching the batt fiber 59 between the roll 51 and the reinforcing fiber substrate 21, and thereafter heating and curing the water-impermeable resin 27.

The surface structure, in which recesses and protrusions are irregularly distributed in a portion of the water-impermeable resin layer 27; the impermeable resin layer and the batt fiber 26; or the impermeable resin layer 27 and the staple fibers 26, maybe formed on the roll side layer surface 23 of the belt 20 in accordance with embodiments of the present invention. The roll side layer surface 23 of the roll side layer 25 has a surface structure, in which the percentage of the contact area with the roll per unit area is 10% to 75%, preferably 10% to 65%, and a surface roughness Ra (arithmetic mean roughness) of 50-150 μm, preferably 60-120 μm. In addition, the percentage of the contact area of the wet web contact side layer surface 22 with the roll per unit area is made to be 85% or more and the surface roughness Ra (arithmetic mean roughness) is made to be 3-40 μm by polishing the water-impermeable resin 27 surface forming the wet web contact side layer surface 22 by the polishing apparatus 48.

For an exemplary method for measuring a surface roughness Ra, first, the data of the transverse section of the belt 20 is photographed (test length: 10 mm; resolving power: 10 μm/pixel) using an X-ray CT scanner. Then, the contour of the border of the back surface is extracted from the image data of the cross section of the belt using the image processing software "Photoshop" (trade name of Adobe Systems Inc.) and the contour is further converted into coordinate data using "Image J" (NIH public domain software, U.S.A.). The coordinate value converted as the data is used to calculate Ra (arithmetic mean roughness).

Figure 6:
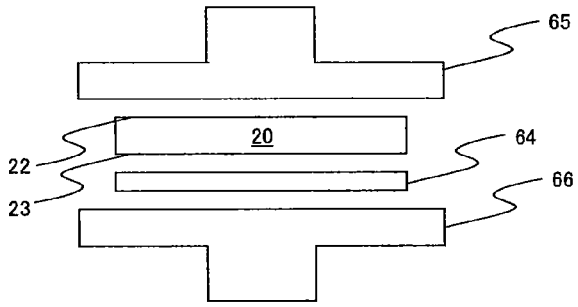
FIG. 6 is a schematic view of a device for measuring the percentage of contact area of a belt for transferring a wet web with a roll side surface per unit area.
Figure 7:
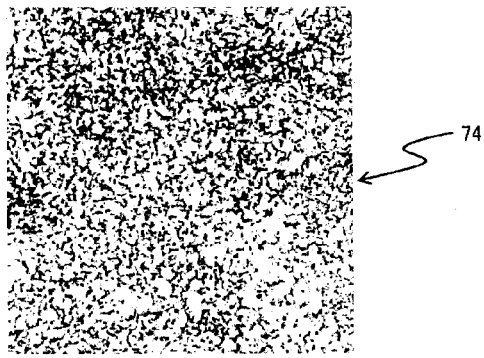
FIG. 7 is a view of a pre-scale with which the percentage of the contact area of the belt for transferring a wet web is measured by the device illustrated in FIG. 6.

The percentage of the contact area the roll side layer surface 23 structure of the belt 20 with the roll per unit area may be measured, in embodiments, using a device for measuring the percentage of a contact area as illustrated in FIG. 6. A pre-scale for low pressure (64, manufactured by Fujifilm Corporation) is placed adjacently to the roll side surface 23 of the belt 20 and sandwiched between an upper press plate 65 and a lower press plate 66 and a pressure of 4 MPa is applied to the belt 20 and the pre-scale. Since a portion to which a certain pressure or more is applied is colored in the pre-scale, the colored portion of the pre-scale can be confirmed as a contact portion between the pre-scale and the roll side surface of the belt for transferring a wet web. That is, the colored portion of the pre-scale can be regarded as a contact portion between the roll in the actual papermaking machine and the roll side surface of the belt for transferring a wet web.

The above-described pre-scale in which the contact portion with the roll side surface of the belt is colored is captured as an image into a computer, the area proportion of the colored portion is calculated as a contact proportion between the roll and the roll side surface of the belt using the imaging software "Photoshop" (trade name manufactured by Adobe Systems Inc.).

In addition, the present invention provide the following embodiments (1) to (20).

(1) A belt for transferring a wet web in a papermaking machine, comprising:

a layer of a water-impermeable resin; and a reinforcing fiber substrate embedded in the water-impermeable resin layer;

wherein:

the water-impermeable resin layer comprises a wet web contact side portion and a roll side portion;

the wet web contact side portion is located on a first side of the reinforcing fiber substrate;

the roll side portion is located on a second side of the reinforcing fiber substrate opposite from the first side;

the wet web contact side portion contacts the wet web during operation of the papermaking machine;

the roll side portion contacts a roll during operation of the papermaking machine;

a surface of the roll side portion has a surface roughness Ra of 50 to 150 μm; and when the surface of the roll side portion is in contact with the roll during operation of the papermaking machine, a contact area of the surface of the roll side portion with the roll per unit area is from 10% to 75%.

(2) The belt according to (1), wherein the surface of the roll side portion has a surface roughness Ra of 60 to 120 μm.

(3) The belt according to (1), wherein when the surface of the roll side portion is in contact with the roll during operation of the papermaking machine, a contact area of the surface of the roll side portion with the roll per unit area is from 10% to 60%.

(4) The belt according to (1), wherein:

a surface of the wet web contact side portion has a surface roughness Ra of 3 to 40 μm; and when the surface of the wet web contact side portion is in contact with the wet web during operation of the papermaking machine, a contact area of the surface of the wet web contact side portion with the wet web per unit area is at least 85%.

(5) The belt according to (1), wherein the reinforcing fiber substrate comprises fibers of at least one member selected from the group consisting of polyethylene terephthalate, polybutylene terephthalate, polyamide 11, polyamide 12, polyamide 612, aramid, polyvinylidene fluoride, polypropylene, polyethylene ester ether ketone (PEEK), polytetrafluoroethylene (PTFE), polyethylene, sheep wool, cotton, wool, and metal.

(6) The belt according to (1), wherein the reinforcing fiber substrate comprises fibers of polyamide 6.

(7) The belt according to (1), wherein:

the roll side portion comprises a batt fiber or staple fibers dispersed in the water-impermeable resin; and the surface of the roll side portion comprises fibers protruding from the water-impermeable resin.

(8) The belt according to (7), wherein:

the roll side portion comprises the batt fiber; and the batt fiber is integrated with the reinforcing fiber substrate.

(9) The belt according to (8), wherein the batt fiber comprises fibers of at least one member selected from the group consisting of polyethylene terephthalate, polybutylene terephthalate, polyamide 11, polyamide 12, polyamide 612, aramid, polyvinylidene fluoride, polypropylene, polyethylene ester ether ketone (PEEK), polytetrafluoroethylene (PTFE), polyethylene, sheep wool, cotton, wool, and metal.

(10) The belt according to (8), wherein the batt fiber comprises fibers of polyamide 6.

(11) The belt according to (7), wherein the roll side portion comprises the staple fibers.

(12) The belt according to (11), wherein the staple fibers comprise fibers of at least one member selected from the group consisting of polyethylene terephthalate, polybutylene terephthalate, polyamide 11, polyamide 12, polyamide 612, aramid, polyvinylidene fluoride, polypropylene, polyethylene ester ether ketone (PEEK), polytetrafluoroethylene (PTFE), polyethylene, sheep wool, cotton, wool, and metal.

(13) The belt according to (11), wherein the staple fibers comprise aramid fibers.

(14) The belt according to (1), wherein:

the water-impermeable resin comprises a polyurethane;

the polyurethane is obtained by heating and curing a coating agent comprising a polyurethane resin composition; and the polyurethane resin composition comprises a urethane prepolymer and a chain extender.

(15) The belt according to (14), wherein the urethane prepolymer is obtained by reacting:

at least one diisocyanate compound selected from the group consisting of toluene diisocyanate (TDI), diphenylmethane diisocyanate (MDI), and para-phenylene diisocyanate (PPDI); and at least one aliphatic polyol selected from the group consisting of tetramethylene glycol (PTMG), tetraethylene glycol (PTEG), and polyethylene glycol (PEG).

(16) The belt according to (14), wherein the chain extender comprises at least one member selected from the group consisting of 1,4-butanediol, diethylene glycol, dimethyl thio toluene diamine, 1,2-bis(2-aminophenylthio)ethane, methylene-bis-(ortho-chloroaniline), and 4,4'-methylene-bis-(3-chloro-2,6-diethylaniline).

(17) The belt according to (14), wherein:

the urethane prepolymer comprises a TDI/PTMG-based urethane prepolymer; and the curing agent comprises dimethyl thio toluene diamine and 1,4-butanediol.

(18) The belt according to (17), wherein the polyurethane resin composition further comprises calcined kaolin.

(19) The belt according to (14), wherein the polyurethane resin composition further comprises an inorganic filler.

(20) The belt according to (19), wherein the an inorganic filler comprises at least one member selected from the group consisting of titanium oxide, calcined kaolin, clay, talc, diatomaceous earth, calcium carbonate, calcium silicate, magnesium silicate, fused silica, mica, and zeolite.

EXAMPLES

In the following examples, and throughout this specification, all parts and percentages are by weight, and all temperatures are in degrees Celsius, unless expressly stated to be otherwise. Where the solids content of a dispersion or solution is reported, it expresses the weight of solids based on the total weight of the dispersion or solution, respectively. Where a molecular weight is specified, it is the molecular weight range ascribed to the product by the commercial supplier, which is identified. Generally this is believed to be weight average molecular weight.

Embodiments of the present invention will be described in more detail with reference to Examples and Comparative Examples below. The reinforcing fiber substrates employed in Examples 1-10 and Comparative Examples 1-4 are as follows:

Reinforcing fiber substrate (woven fabric with material: polyamide 6; weave: warp double cloth; and basis weight: 600 g/m$^2$).

All the belts for transferring a wet web were produced to have a length dimension of 20 m in length×70 cm in width.

In addition, a polyurethane resin composition prepared by blending TDI/PTMG-based urethane prepolymer with a curing agent (also referred to as a chain extender) of the 3:1 mixture of Ethacure 300 with 1,4-butanediol was used as the water-impermeable resin.

Example 1

As a method for manufacturing the belt for transferring a wet web 20, production was performed by the back surface coat reverse manufacturing method.

The surface (wet web contact side layer) of the reinforcing fiber substrate was put to contact with two rolls disposed in parallel and the polyurethane composition prepared by blending TDI/PTMG-based urethane prepolymer with the curing agent (also referred to as a chain extender) of the 3:1 mixture of Ethacure 300 with 1,4-butanediol was applied to the back surface (roll side layer) of the reinforcing fiber substrate at 100° C. while rotating the rolls. The polyurethane composition was heated to 120° C. and cured while forming irregular recesses and protrusions on the surface by the emboss roll 47 within the period during which the applied polyurethane composition was in an uncured state. The belt for transferring a wet web which was a semi-finished product was reversed, the polyurethane resin layer formed on the back surface (roll side layer) of the reinforcing fiber substrate 21 was put to contact with the rolls, and the polyurethane composition was applied to the surface (wet web contact side layer) of the reinforcing fiber substrate at 100° C. while rotating the rolls and heated to 120° C. and cured. Finally, the surface (wet web contact surface 22 of the belt for transferring a wet web was polished to complete the belt for transferring a wet web having a final product basis weight of 2,900 g/m2 and a thickness of 2.8 mm.

The percentage of the contact area of the roll side layer surface 23 of the obtained belt for transferring a wet web 20 with the roll per unit area was 55% and the surface roughness Ra of the roll side layer surface was 70 μm. In addition, the control rate of the belt for transferring a wet web 20 used in a papermaking machine was able to be 1,700 m/min and the amount of water was 23 mg. Any wet web mark was not observed on the paper made by the papermaking machine.

Example 2

As a method for manufacturing the belt for transferring a wet web 20, production was performed by the surface coat penetration manufacturing method. The back surface roll side layer) of the reinforcing fiber substrate was entangled and integrated with a batt fiber having a basis weight of 100 g/m2 comprising polyamide 6 having a fineness of 22 dtex and a cut length of 76 mm by needling. Further, the front surface wet web contact side layer) of the reinforcing fiber substrate was entangled and integrated with a batt fiber having a basis weight of 300 g/m2 comprising polyamide 6 having a fineness of 3 dtex and a cut length of 76 mm by needling.

The batt fiber integrated into the back surface of the reinforcing fiber substrate was put to contact with two rolls disposed in parallel, a polyurethane resin composition was applied to the front surface (wet web contact side layer) of the reinforcing fiber substrate while rotating the rolls, and the applied polyurethane resin composition was made to penetrate from the front surface of the reinforcing fiber substrate to the back surface and was cured. Finally, the front surface (wet web contact surface) of the belt for transferring a wet web was polished to complete the belt for transferring a wet web having a final product basis weight of 2,900 g/m2 and a thickness of 2.8 mm.

The percentage of the contact area of the roll side layer surface 23 of the obtained belt for transferring a wet web 20 with the roll per unit area was 45% and the surface roughness Ra of the roll side layer surface was 80 μm. In addition, the control rate of the belt for transferring a wet web 20 used in a papermaking machine was able to be 1,700 m/min and the amount of water was 10 mg. Any wet web mark was not observed on the paper made by the papermaking machine.

Example 3

As a method for manufacturing the belt for transferring a wet web 20, production was performed by the surface coat penetration manufacturing method. The front surface (wet web contact side layer) of the reinforcing fiber substrate was entangled and integrated with a batt fiber having a basis weight of 300 g/m2 comprising polyamide 6 having a fineness of 3 dtex and a cut length of 76 mm by needling. The back surface roll side layer) of the reinforcing fiber substrate was put to contact with two rolls disposed in parallel, a polyurethane resin composition was applied to the front surface (wet web contact side layer) of the reinforcing fiber substrate while rotating the rolls, and the applied polyurethane resin composition was made to penetrate from the front surface of the reinforcing fiber substrate to the back surface. In this case, a batt fiber (in mat form) having a basis weight of 100 g/m2 comprising polyamide 6 having a fineness of 22 dtex and a cut length of 76 mm was adhered to the uncured polyurethane resin composition penetrating to the back surface of the reinforcing fiber substrate, the batt fiber was sandwiched between the roll and the reinforcing fiber substrate, and the polyurethane resin composition was cured. Finally, the front surface (wet web contact surface) of the belt for transferring a wet web was polished to complete the belt for transferring a wet web having a final product basis weight of 2,900 g/m2 and a thickness of 2.8 mm.

The percentage of the contact area of the roll side layer surface 23 of the obtained belt for transferring a wet web 20 with the roll per unit area was 45% and the surface roughness Ra of the roll side layer surface was 80 μm. In addition, the control rate of the belt for transferring a wet web 20 used in a papermaking machine was able to be 1,700 m/min and the amount of water was 10 mg. Any wet web mark was not observed on the paper made by the papermaking machine.

Example 4

As a method for manufacturing the belt for transferring a wet web 20, production was performed by the back surface coat reverse manufacturing method. The front surface (wet web contact side layer) of the reinforcing fiber substrate was entangled and integrated with a batt fiber having a basis weight of 300 g/m2 comprising polyamide 6 having a fineness of 3 dtex and a cut length of 76 mm by needling. The batt fiber integrated into the front surface (wet web contact side layer) of the reinforcing fiber substrate was put to contact with two rolls disposed in parallel and a polyurethane resin composition was applied to the back surface (roll side layer) of the reinforcing fiber substrate while rotating the rolls. The polyurethane resin composition was mixed with 2% by weight of a staple fiber, comprising "Kevlar"® having a fineness of 1.7 dtex and a cut length of 6 mm, based on the weight of the resin. After coating of the urethane resin, the resin was cured while forming irregular recesses and protrusions on the surface in the state of the uncured urethane resin by an emboss roll. The belt for transferring a wet web which was a semi-finished product was reversed, the urethane resin layer formed on the back surface (roll side layer) of the reinforcing fiber substrate was put to contact with the rolls, and the urethane resin was coated on a batt fiber entangled and integrated into the front surface (wet web contact side layer) of the reinforcing fiber substrate while rotating the rolls and cured. Finally, the front surface (wet web contact surface) of the belt for transferring a wet web was polished to complete the belt for transferring a wet web having a final product basis weight of 2,900 g/m2 and a thickness of 2.8 mm.

The percentage of the contact area of the roll side layer surface 23 of the obtained belt for transferring a wet web 20 with the roll per unit area was 55% and the surface roughness Ra of the roll side layer surface was 70 μm. In addition, the control rate of the belt for transferring a wet web 20 used in a papermaking machine was able to be 1,700 m/min and the amount of water was 15 mg. Any wet web mark was not observed on the paper made by the papermaking machine.

Example 5

As a method for manufacturing the belt for transferring a wet web 20, production was performed by the surface coat penetration manufacturing method. The back surface (roll side layer) of the reinforcing fiber substrate was entangled and integrated with a batt fiber having a basis weight of 90 g/m2 comprising polyamide 6 having a fineness of 3 dtex and a cut length of 76 mm by needling. Further, the front surface (wet web contact side layer) of the reinforcing fiber substrate was entangled and integrated with a batt fiber having a basis weight of 300 g/m2 comprising polyamide 6 having a fineness of 3 dtex and a cut length of 76 mm by needling. The batt fiber integrated into the back surface of the reinforcing fiber substrate was put to contact with two rolls disposed in parallel, a polyurethane resin composition was coated on the front surface (wet web contact side layer) of the reinforcing fiber substrate while rotating the rolls, and the applied polyurethane resin composition was made to penetrate from the front surface of the reinforcing fiber substrate to the back surface and was cured. The polyurethane resin composition was mixed with 10% by weight of calcined kaolin having an average particle diameter of 1.4 μm based on the weight of the resin. Finally, the front surface (wet web contact surface) of the belt for transferring a wet web was polished to complete the belt for transferring a wet web having a final product basis weight of 2,800 g/m2 and a thickness of 2.7 mm.

The percentage of the contact area of the roll side layer surface 23 of the obtained belt for transferring a wet web 20 with the roll per unit area was 75% and the surface roughness Ra of the roll side layer surface was 50 μm. In addition, the control rate of the belt for transferring a wet web 20 used in a papermaking machine was able to be 1,650 m/min and the amount of water was 4 mg. Any wet web mark was not observed on the paper made by the papermaking machine.

Example 6

As a method for manufacturing the belt for transferring a wet web 20, production was performed by the surface coat penetration manufacturing method. The back surface (roll side layer) of the reinforcing fiber substrate was entangled and integrated with a batt fiber having a basis weight of 100 g/m2 comprising polyamide 6 having a fineness of 11 dtex and a cut length of 76 mm by needling. Further, the front surface (wet web contact side layer) of the reinforcing fiber substrate was entangled and integrated with a batt fiber having a basis weight of 300 g/m2 comprising polyamide 6 having a fineness of 3 dtex and a cut length of 76 mm by needling. The batt fiber integrated into the back surface of the reinforcing fiber substrate was put to contact with two rolls disposed in parallel, a polyurethane resin composition was applied to the front surface (wet web contact side layer) of the reinforcing fiber substrate while rotating the rolls, and the applied polyurethane resin composition was made to penetrate from the front surface of the reinforcing fiber substrate to the back surface, and then heated and cured at 120° C. The polyurethane resin composition was mixed with 10% by weight of calcined kaolin having an average particle diameter of 1.4 μm based on the weight of the resin. Finally, the front surface (wet web contact surface) of the belt for transferring a wet web was polished to complete the belt for transferring a wet web having a final product basis weight of 2,850 g/m2 and a thickness of 2.75 mm.

The percentage of the contact area of the roll side layer surface 23 of the obtained belt for transferring a wet web 20 with the roll per unit area was 65% and the surface roughness Ra of the roll side layer surface was 60 μm. In addition, the control rate of the belt for transferring a wet web 20 used in a papermaking machine was able to be 1,700 m/min and the amount of water was 5 mg. Any wet web mark was not observed on the paper made by the papermaking machine.

Example 7

As a method for manufacturing the belt for transferring a wet web 20, production was performed by the surface coat penetration manufacturing method. The back surface (roll side layer) of the reinforcing fiber substrate was entangled and integrated with a batt fiber having a basis weight of 100 g/m2 comprising polyamide 6 having a fineness of 22 dtex and a cut length of 76 mm by needling. Further, the front surface (wet web contact side layer) of the reinforcing fiber substrate was entangled and integrated with a batt fiber having a basis weight of 300 g/m2 comprising polyamide 6 having a fineness of 3 dtex and a cut length of 76 mm by needling.

The batt fiber integrated into the back surface of the reinforcing fiber substrate was put to contact with two rolls disposed in parallel, a polyurethane resin composition was coated on the front surface (wet web contact side layer) of the reinforcing fiber substrate while rotating the rolls, and the applied polyurethane resin composition was made to penetrate from the front surface of the reinforcing fiber substrate to the back surface and was cured. The polyurethane resin composition was mixed with 10% by weight of calcined kaolin having an average particle diameter of 1.4 μm based on the weight of the resin. Finally, the front surface (wet web contact surface) of the belt for transferring a wet web was polished to complete the belt for transferring a wet web having a final product basis weight of 3,000 g/m2 and a thickness of 2.8 mm.

The percentage of the contact area of the roll side layer surface 23 of the obtained belt for transferring a wet web 20 with the roll per unit area was 45% and the surface roughness Ra of the roll side layer surface was 80 μm. In addition, the control rate of the belt for transferring a wet web 20 used in a papermaking machine was able to be 1,700 m/min and the amount of water was 7 mg. Any wet web mark was not observed on the paper made by the papermaking machine.

Example 8

As a method for manufacturing the belt for transferring a wet web 20, production was performed by the surface coat penetration manufacturing method. The back surface (roll side layer) of the reinforcing fiber substrate was entangled and integrated with a batt fiber having a basis weight of 100 g/m2 comprising polyamide 6 having a fineness of 33 dtex and a cut length of 76 mm by needling. Further, the front surface (wet web contact side layer) of the reinforcing fiber substrate was entangled and integrated with a batt fiber having a basis weight of 300 g/m2 comprising polyamide 6 having a fineness of 3 dtex and a cut length of 76 mm by needling.

The batt fiber integrated into the back surface of the reinforcing fiber substrate was put to contact with two rolls disposed in parallel, a polyurethane resin composition was applied to the front surface (wet web contact side layer) of the reinforcing fiber substrate while rotating the rolls, and the applied polyurethane resin composition was made to penetrate from the front surface of the reinforcing fiber substrate to the back surface, and heated and cured at 120° C. The polyurethane resin composition was mixed with 10% by weight of calcined kaolin having an average particle diameter of 1.4 μm based on the weight of the resin. Finally, the front surface (wet web contact surface) of the belt for transferring a wet web was polished to complete the belt for transferring a wet web having a final product basis weight of 3,100 g/m2 and a thickness of 2.9 mm.

The percentage of the contact area of the roll side layer surface 23 of the obtained belt for transferring a wet web 20 with the roll per unit area was 30% and the surface roughness Ra of the roll side layer surface was 100 μm. In addition, the control rate of the belt for transferring a wet web 20 used in a papermaking machine was able to be 1,700 m/min and the amount of water was 13 mg. Any wet web mark was not observed on the paper made by the papermaking machine.

Example 9

As a method for manufacturing the belt for transferring a wet web 20, production was performed by the surface coat penetration manufacturing method. The back surface (roll side layer) of the reinforcing fiber substrate was entangled and integrated with a batt fiber having a basis weight of 200 g/m2 comprising polyamide 6 having a fineness of 44 dtex and a cut length of 76 mm by needling. Further, the front surface (wet web contact side layer) of the reinforcing fiber substrate was entangled and integrated with a batt fiber having a basis weight of 300 g/m2 comprising polyamide 6 having a fineness of 3 dtex and a cut length of 76 mm by needling. The batt fiber integrated into the back surface of the reinforcing fiber substrate was put to contact with two rolls disposed in parallel, a polyurethane resin composition was coated on the front surface (wet web contact side layer) of the reinforcing fiber substrate while rotating the rolls, and the applied polyurethane resin composition was made to penetrate from the front surface of the reinforcing fiber substrate to the back surface, and heated and cured at 120° C. The polyurethane resin composition was mixed with 10% by weight of calcined kaolin having an average particle diameter of 1.4 μm based on the weight of the resin. Finally, the front surface (wet web contact surface) of the belt for transferring a wet web was polished to complete the belt for transferring a wet web having a final product basis weight of 3,200 g/m2 and a thickness of 3.0 mm.

The percentage of the contact area of the roll side layer surface 23 of the obtained belt for transferring a wet web 20 with the roll per unit area was 20% and the surface roughness Ra of the roll side layer surface was 120 μm. In addition, the control rate of the belt for transferring a wet web 20 used in a papermaking machine was able to be 1,700 m/min and the amount of water was 20 mg. Any wet web mark was not observed on the paper made by the papermaking machine.

Example 10

As a method for manufacturing the belt for transferring a wet web 20, production was performed by the surface coat penetration manufacturing method. The back surface (roll side layer) of the reinforcing fiber substrate was entangled and integrated with a batt fiber having a basis weight of 200 g/m2 comprising polyamide 6 having a fineness of 55 dtex and a cut length of 76 mm by needling. Further, the front surface (wet web contact side layer) of the reinforcing fiber substrate was entangled and integrated with a batt fiber having a basis weight of 300 g/m2 comprising polyamide 6 having a fineness of 3 dtex and a cut length of 76 mm by needling. The batt fiber integrated into the back surface of the reinforcing fiber substrate was put to contact with two rolls disposed in parallel, a polyurethane resin composition was coated on the front surface (wet web contact side layer) of the reinforcing fiber substrate while rotating the rolls, and the applied polyurethane resin composition was made to penetrate from the front surface of the reinforcing fiber substrate to the back surface, and heated and cured at 120° C. The polyurethane resin composition was mixed with 10% by weight of calcined kaolin having an average particle diameter of 1.4 μm based on the weight of the resin. Finally, the front surface (wet web contact surface) of the belt for transferring a wet web was polished to complete the belt for transferring a wet web having a final product basis weight of 3,300 g/m2 and a thickness of 3.1 mm.

The percentage of the contact area of the roll side layer surface 23 of the obtained belt for transferring a wet web 20 with the roll per unit area was 10% and the surface roughness Ra of the roll side layer surface was 150 μm. In addition, the control rate of the belt for transferring a wet web 20 used in a papermaking machine was able to be 1,700 m/min and the amount of water was 26 mg. Any wet web mark was not observed on the paper made by the papermaking machine.

Comparative Example 1

As a method for manufacturing the belt for transferring a wet web 20, production was performed by the back surface coat reverse manufacturing method.

The front surface (wet web contact side layer) of the reinforcing fiber substrate was put to contact with two rolls disposed in parallel, a polyurethane resin composition was coated on the back surface (roll side layer) of the reinforcing fiber substrate while rotating the rolls, the polyurethane resin composition was cured, and its surface was polished. The belt for transferring a wet web which was a semi-finished product was reversed, the urethane resin layer formed on the back surface (roll side layer) of the reinforcing fiber substrate was put to contact with the rolls, and a polyurethane resin composition was applied to the front surface (wet web contact side layer) of the reinforcing fiber substrate while rotating the rolls and heated and cured at 120° C. Finally, the front surface (wet web contact surface) of the belt for transferring a wet web was polished to complete the belt for transferring a wet web having a final product basis weight of 3,100 g/m2 and a thickness of 2.8 mm.

The percentage of the contact area of the roll side layer surface 23 of the obtained belt for transferring a wet web 20 with the roll per unit area was 97% and the surface roughness Ra of the roll side layer surface was 5 μm. In addition, the control rate of the belt for transferring a wet web 20 used in a papermaking machine was able to be 1,300 m/min and the amount of water was 15 mg. Any wet web mark was not observed on the paper made by the papermaking machine.

Comparative Example 2

As a method for manufacturing the belt for transferring a wet web 20, production was performed by the back surface coat reverse manufacturing method. The front surface (wet web contact side layer) of the reinforcing fiber substrate was put to contact with two rolls disposed in parallel, a polyurethane resin composition was applied to the back surface (roll side layer) of the reinforcing fiber substrate while rotating the rolls, the polyurethane resin composition was cured at 100° C., and its surface was polished. The polyurethane resin composition was mixed with 10% by weight of calcined kaolin having an average particle diameter of 1.4 μm based on the weight of the resin. The belt for transferring a wet web which was a semi-finished product was reversed, the polyurethane resin composition layer formed on the back surface (roll side layer) of the reinforcing fiber substrate was put to contact with the rolls, and a polyurethane resin composition was applied to the front surface (wet web contact side layer) of the reinforcing fiber substrate while rotating the rolls, and the polyurethane resin composition was pre-heated at 100° C., then post-cured at 120° C., and cured. Finally, the front surface (wet web contact surface) of the belt for transferring a wet web was polished to complete the belt for transferring a wet web having a final product basis weight of 3,200 g/m2 and a thickness of 2.8 mm.

The percentage of the contact area of the roll side layer surface 23) of the obtained belt for transferring a wet web 20) with the roll per unit area was 97% and the surface roughness Ra of the roll side layer surface was 5 μm. In addition, the control rate of the belt for transferring a wet web 20) used in a papermaking machine was able to be 1,300 m/min and the amount of water was 5 mg. Any wet web mark was not observed on the paper made by the papermaking machine.

Comparative Example 3

As a method for manufacturing the belt for transferring a wet web 20, production was performed by the surface coat penetration manufacturing method. The back surface (roll side layer) of the reinforcing fiber substrate was entangled and integrated with a batt fiber having a basis weight of 100 g/m2 comprising polyamide 6 having a fineness of 3 dtex and a cut length of 76 mm by needling. Further, the front surface (wet web contact side layer) of the reinforcing fiber substrate was entangled and integrated with a bait fiber having a basis weight of 300 g/m2 comprising polyamide 6 having a fineness of 3 dtex and a cut length of 76 mm by needling. Then, calender-treatment of the back surface (roll side layer) was performed by heat roll press to improve smoothness. The bat fiber integrated into the back surface of the reinforcing fiber substrate was put to contact with two rolls disposed in parallel, a polyurethane resin composition was applied to the front surface (wet web contact side layer) of the reinforcing fiber substrate while rotating the rolls, and the applied polyurethane resin composition was made to penetrate from the front surface of the reinforcing fiber substrate to the back surface, pre-heated at 100° C., post-cured at 120° C., and cured. The polyurethane resin was mixed with 10% by weight of calcined kaolin having an average particle diameter of 1.4 μm based on the weight of the resin. Finally, the front surface (wet web contact surface) and the back surface (roll contact surface) of the belt for transferring a wet web were polished to complete the belt for transferring a wet web having a final product basis weight of 2,800 g/m2 and a thickness of 2.6 mm.

The percentage of the contact area of the roll side layer surface 23 of the obtained belt for transferring a wet web 20 with the roll per unit area was 85% and the surface roughness Ra of the roll side layer surface was 20 μm. In addition, the control rate of the belt for transferring a wet web 20 used in a papermaking machine was able to be 1,350 m/min and the amount of water was 3 mg. Any wet web mark was not observed on the paper made by the papermaking machine.

Comparative Example 4

As a method for manufacturing the belt for transferring a wet web 20, production was performed by the back surface coat reverse manufacturing method. The front surface (wet web contact side layer) of the reinforcing fiber substrate was entangled and integrated with a batt fiber having a basis weight of 300 g/m2 comprising polyamide 6 having a fineness of 3 dtex and a cut length of 76 mm by needling. The batt fiber integrated into the front surface (wet web contact side layer) of the reinforcing fiber substrate was put to contact with two rolls disposed in parallel and a polyurethane resin composition was applied to the back surface (roll side layer) of the reinforcing fiber substrate at 100° C. while rotating the rolls and heated and cured at 120° C. The polyurethane resin composition was mixed with 10% by weight of calcined kaolin having an average particle diameter of 1.4 μm based on the weight of the resin. The belt for transferring a wet web which was a semi-finished product was reversed, the polyurethane resin layer formed on the back surface (roll side layer) of the reinforcing fiber substrate was put to contact with the rolls, and a polyurethane resin composition was applied to the batt fiber entangled and integrated into the front surface (wet web contact side layer) of the reinforcing fiber substrate at 100° C. while rotating the rolls and heated and cured at 120° C. Finally, the front surface (wet web contact surface) of the belt for transferring a wet web was polished and grooves having a groove width of 1.0 mm, a groove depth of 0.8 mm, a pitch of 9.8 threads/inch, and an opening ratio of 38.5% were further formed at regular spacings on the back surface (roll contact surface) to complete the belt for transferring a wet web having a final product basis weight of 3,100 g/m2 and a thickness of 3.0 mm.

The percentage of the contact area of the roll side layer surface 23 of the obtained belt for transferring a wet web 20 with the roll per unit area was 70%. In addition, the control rate of the belt for transferring a wet web 20 used in a papermaking machine was able to be 1,500 m/min and the amount of water was 23 mg. Wet web marks were observed on the paper made by the papermaking machine (marks prepared by copying marks, made by the groove formed at the regular spacings on the roll side layer surface of the belt for transferring a wet web, on the wet web). In the belt for transferring a wet web 20, because of its design, the percentage of the contact area had been expected to be 61.5% by formation of the grooves having an opening ratio of 38.5% at the regular spacings; however, the grooves were clogged by applied pressure when the percentage of the contact area per unit area was measured, so that the percentage of the actual contact area per unit area was 70% as described above.

The physical properties of the materials for manufacturing the belts for transferring a wet web of Examples 1-10 and Comparative Examples 1-4 as described above and the evaluated physical properties of the obtained belts for transferring a wet web are summarized in TABLES 1-1 to 1-3 and TABLE 2.

TABLE 1-1

| | | Design of belt for transferring wet web Wet web contact side layer | | | | | | | | |
|---|---|---|---|---|---|---|---|---|---|---|
| | | Resin | | | | Fiber | | | | |
| | | | Addition of filler | | | | | | | |
| | Basic manufacturing method | Material | Material | Average particle diameter (μm) | Addition amount (wt %) | Material | Fiber (dtex) | Cut length (mm) | Basis weight (g/m2) | Placement method |
| Example 1 | Back surface coat reverse manufacturing method | Urethane | — | — | — | — | — | — | — | — |
| Example 2 | Surface coat penetration manufacturing method | Urethane | — | — | — | Polyamide 8 | 3 | 76 | 300 | Needling |
| Example 3 | Surface coat penetration manufacturing method | Urethane | — | — | — | Polyamide 8 | 3 | 76 | 300 | Needling |
| Example 4 | Back surface coat reverse manufacturing method | Urethane | — | — | — | Polyamide 8 | 3 | 76 | 300 | Needling |
| Example 5 | Surface coat penetration manufacturing method | Urethane | Calcined kaolin | 1.4 | 10 | Polyamide 8 | 3 | 76 | 300 | Needling |
| Example 6 | Surface coat penetration manufacturing method | Urethane | Calcined kaolin | 1.4 | 10 | Polyamide 8 | 3 | 76 | 300 | Needling |
| Example 7 | Surface coat penetration manufacturing method | Urethane | Calcined kaolin | 1.4 | 10 | Polyamide 8 | 3 | 76 | 300 | Needling |
| Example 8 | Surface coat penetration manufacturing method | Urethane | Calcined kaolin | 1.4 | 10 | Polyamide 8 | 3 | 76 | 300 | Needling |

TABLE 1-1-continued

| | | Design of belt for transferring wet web Wet web contact side layer | | | | | | | | |
|---|---|---|---|---|---|---|---|---|---|---|
| | | Resin | | | | Fiber | | | | |
| | | | Addition of filler | | | | | | | |
| | Basic manufacturing method | Material | Material | Average particle diameter (μm) | Addition amount (wt %) | Material | Fiber (dtex) | Cut length (mm) | Basis weight (g/m2) | Place-ment method |
| Example 9 | Surface coat penetration manufacturing method | Urethane | Calcined kaolin | 1.4 | 10 | Polyamide 8 | 3 | 76 | 300 | Needling |
| Example 10 | Surface coat penetration manufacturing method | Urethane | Calcined kaolin | 1.4 | 10 | Polyamide 8 | 3 | 76 | 300 | Needling |
| Comparative Example 1 | Back surface coat reverse manufacturing method | Urethane | — | — | — | — | — | — | — | — |
| Comparative Example 2 | Back surface coat reverse manufacturing method | Urethane | Calcined kaolin | 1.4 | 10 | — | — | — | — | — |
| Comparative Example 3 | Surface coat penetration manufacturing method | Urethane | Calcined kaolin | 1.4 | 10 | Polyamide 8 | 3 | 76 | 300 | Needling |
| Comparative Example 4 | Back surface coat reverse manufacturing method | Urethane | Calcined kaolin | 1.4 | 10 | Polyamide 8 | 3 | 76 | 300 | Needling |

TABLE 1-2

| | | Roll side layer | | | | | | | | |
|---|---|---|---|---|---|---|---|---|---|---|
| | | | | | | | Resin | | | |
| | | Fiber | | | | | | Addition of filler | | |
| | Reinforcing fiber substrate | Material | Fiber (dtex) | Cut length (mm) | Basis weight (g/m2) | Placement method | Material | Material | Average particle diameter (μm) | Addition amount (wt %) |
| Example 1 | Present | — | — | — | — | — | Urethane | — | — | — |
| Example 2 | Present | Polyamide 8 | 22 | 76 | 100 | Needling | Urethane | — | — | — |
| Example 3 | Present | Polyamide 8 | 22 | 76 | 100 | Adjacent placement | Urethane | — | — | — |
| Example 4 | Present | Keblar | 1.7 | 6 | 2 wt % for resin | Mixing into resin | Urethane | — | — | — |
| Example 5 | Present | Polyamide 8 | 3 | 76 | 90 | Needling | Urethane | Calcined kaolin | 1.4 | 10 |
| Example 6 | Present | Polyamide 8 | 11 | 76 | 100 | Needling | Urethane | Calcined kaolin | 1.4 | 10 |
| Example 7 | Present | Polyamide 8 | 22 | 76 | 100 | Needling | Urethane | Calcined kaolin | 1.4 | 10 |
| Example 8 | Present | Polyamide 8 | 33 | 76 | 100 | Needling | Urethane | Calcined kaolin | 1.4 | 10 |
| Example 9 | Present | Polyamide 8 | 44 | 76 | 200 | Needling | Urethane | Calcined kaolin | 1.4 | 10 |
| Example 10 | Present | Polyamide 8 | 55 | 76 | 200 | Needling | Urethane | Calcined kaolin | 1.4 | 10 |
| Comparative Example 1 | Present | — | — | — | — | — | Urethane | — | — | — |
| Comparative Example 2 | Present | — | — | — | — | — | Urethane | Calcined kaolin | 1.4 | 10 |
| Comparative Example 3 | Present | Polyamide 8 | 3 | 76 | 100 | Needling | Urethane | Calcined kaolin | 1.4 | 10 |
| Comparative Example 4 | Present | — | — | — | — | — | Urethane | Calcined kaolin | 1.4 | 10 |

TABLE 1-3

| | Roll side layer surface structure | | |
|---|---|---|---|
| | Percentage of contact area (%) | Surface roughness Ra (μm) | Groove processing |
| Example 1 | 55 | 70 | x |
| Example 2 | 45 | 80 | x |
| Example 3 | 45 | 80 | x |
| Example 4 | 55 | 70 | x |
| Example 5 | 75 | 50 | x |
| Example 6 | 65 | 60 | x |
| Example 7 | 45 | 80 | x |
| Example 8 | 30 | 100 | x |
| Example 9 | 20 | 120 | x |
| Example 10 | 10 | 150 | x |
| Comparative Example 1 | 97 | 5 | x |
| Comparative Example 2 | 97 | 5 | x |
| Comparative Example 3 | 85 | 20 | x |
| Comparative Example 4 | 70 | — | Grooves having a groove width of 1.0 mm, a groove depth of 0.8 mm, 9.8 threads/inch, and an opening ratio of 38.5% at regular spacings |

TABLE 2

| | Evaluation results | | |
|---|---|---|---|
| | Guiding characteristics (controllable rate) | Marking characteristics | Wear characteristics |
| Example 1 | 1700 m/min | Absent | 23 mg |
| Example 2 | 1700 m/min | Absent | 10 mg |
| Example 3 | 1700 m/min | Absent | 10 mg |
| Example 4 | 1700 m/min | Absent | 15 mg |
| Example 5 | 1650 m/min | Absent | 4 mg |
| Example 6 | 1700 m/min | Absent | 5 mg |
| Example 7 | 1700 m/min | Absent | 7 mg |
| Example 8 | 1700 m/min | Absent | 13 mm |
| Example 9 | 1700 m/min | Absent | 20 mg |
| Example 10 | 1700 m/min | Absent | 26 mg |
| Comparative Example 1 | 1300 m/min | Absent | 15 mg |
| Comparative Example 2 | 1300 m/min | Absent | 5 mg |
| Comparative Example 3 | 1350 m/min | Absent | 3 mg |
| Comparative Example 4 | 1500 m/min | Present | 23 mg |

Evaluation of the belts shown in TABLE 2 was carried out as described below.

Figure 8:
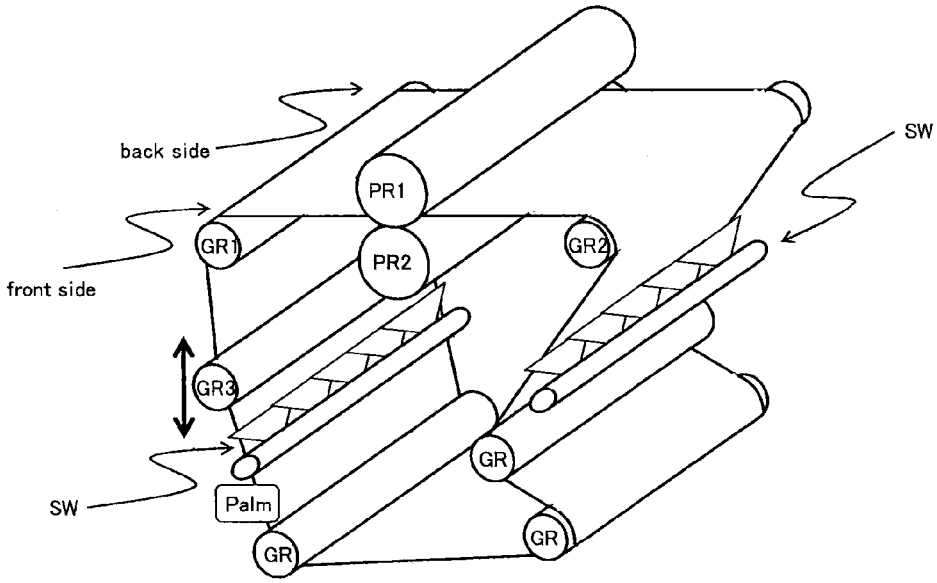
FIG. 8 is a schematic view of a testing device used for evaluation of guiding characteristics.

Guiding Characteristics:

In the testing device in FIG. 8, distances between the guide rolls GR1, GR2 were fixed so that the distance of the front side was shorter than that of the back side. This results in a difference between the peripheral lengths of the front and back sides of the belt for transferring a wet web put in the testing device to unbalance the belt for transferring a wet web to the front side which has the shorter peripheral length during traveling. When the belt for transferring a wet web is unbalanced, usually, a palm disposed in the testing device detects the unbalance of the belt for transferring a wet web to correct the unbalance of the belt for transferring a wet web by vertically moving the position of the front side (or the position of the back side) of the guide roll GR3 depending on a detection amount, so that the belt can be stably and continuously conveyed.

Each belt was put in the testing device of FIG. 8 as described above and was conveyed at the tensile force of the belt for transferring a wet web of 3.5 kN/m. The rate just before correction of the unbalance became impossible, causing uncontrollability, was measured.

Figure 9:
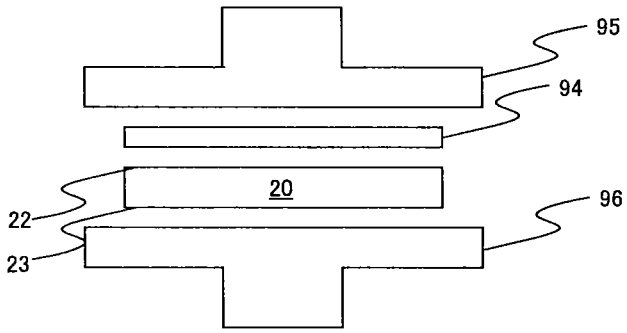
FIG. 9 is a schematic view of a testing device used for evaluation of marking characteristics.

Marking Characteristics:

Each belt was arranged in the testing device of FIG. 9 so that a roll side layer surface of the belt contacted a lower press plate. Then, a wet web having a water content of 50% was placed on a wet web contact side layer surface of the belt and the belt and the wet web were pressurized at 4 MPa. After the pressurization, the wet web was dried to check the surface state of the wet web by visual observation. The belts of Examples 1-10 and Comparative Examples 1-3 did not have any particular problems and exhibited good mark characteristics. However, with the belt of Comparative Example 4 marks made by the grooves formed at regular spacing on the roll side layer surface of the belt were confirmed to be copied on the paper.

Figure 10:
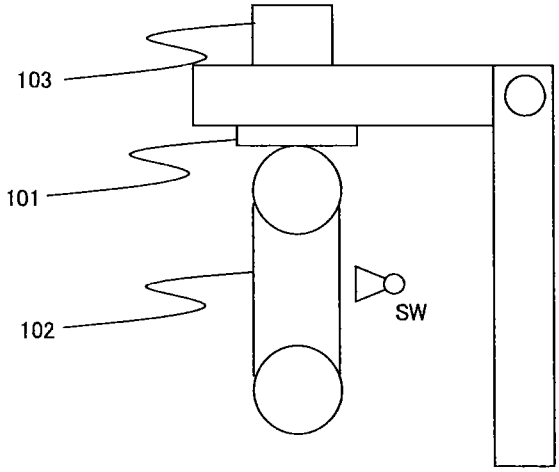
FIG. 10 is a schematic view of a testing device used for evaluation of wear characteristics.

Wear Characteristics:

A belt for transferring a wet web, as a sample, was arranged in the testing device of FIG. 10 so that the roll side surface of the belt for transferring a wet web contacted with a worn cloth, put between two rolls of 10 cm in diameter, at a linear pressure 5 kg/cm2. Then, the worn cloth was conveyed at 20 m/min for 10 minutes while pouring shower water on the worn cloth to wear the roll side layer surface of the belt. A change in weight of the belt before and after wearing was measured.

The belt for transferring a wet web in accordance with an embodiment of the present invention is a belt for transferring a wet web wherein skids between the belt for transferring a wet web and various rolls, particularly a roll for controlling a travel position, caused by a hydroplaning phenomenon, are prevented; and the belt for transferring a wet web is not damaged by fluid under pressurization. In addition, since the wear resistance of the roll side of the belt for transferring a wet web is high, the life of the belt for transferring a wet web is also long. Further, the belt for transferring a wet web has improved marking characteristics for a wet web.

Where a numerical limit or range is stated herein, the endpoints are included. Also, all values and subranges within a numerical limit or range are specifically included as if explicitly written out.

Obviously, numerous modifications and variations of the present invention are possible in light of the above teachings. It is therefore to be understood that, within the scope of the appended claims, the invention may be practiced otherwise than as specifically described herein.

All patents and other references mentioned above are incorporated in full herein by this reference, the same as if set forth at length.

The invention claimed is:

1. A belt for transferring a wet web, comprising a reinforcing fiber substrate buried in a water-impermeable resin layer, wherein:

the belt for transferring a wet web comprises a wet web contact side layer which contacts with a wet web and a roll side layer opposite to the wet web contact side layer;

a roll side layer surface of the roll side layer comprises a surface structure in which a percentage of a contact area with a roll per unit area is 10% to 75% and has a surface roughness Ra of 50-150 μm; and the roll side layer comprises the surface structure wherein recesses and protrusions are irregularly distributed on the water-impermeable resin layer.

2. The belt for transferring a wet web according to claim 1, wherein the surface roughness Ra is 50-120 μm.

3. The belt for transferring a wet web according to claim 1, wherein the roll side layer comprises a fiber selected from a batt fiber and a staple fiber, comprising a surface structure in which a part of the fiber protrudes from the surface of the roll side layer.

4. The belt for transferring a wet web according to claim 1, wherein the water-impermeable resin is polyurethane.

5. The belt for transferring a wet web according to claim 1, wherein the resin in the water-impermeable resin layer is made of polyurethane obtained by heating and curing a coating agent comprising a polyurethane resin composition containing a urethane prepolymer, a chain extender, and an inorganic filler.

* * * * *